United States Patent [19]

Terrels

[11] 4,184,778

[45] Jan. 22, 1980

[54] CUP FOR PAINT SPRAYER

[76] Inventor: Joseph L. Terrels, 111 S. Bolmar St., West Chester, Pa. 19380

[21] Appl. No.: 19,302

[22] Filed: Mar. 12, 1979

[51] Int. Cl.[2] ..... B01F 7/22

[52] U.S. Cl. ..... 366/250; 239/142

[58] Field of Search ..... 366/250, 129, 130, 249, 366/247; 239/142

[56] References Cited

U.S. PATENT DOCUMENTS

| | | | |
|---|---|---|---|
| 1,784,416 | 12/1930 | Brockmann | 366/250 |
| 3,412,937 | 11/1968 | Chamberlain | 366/243 |
| 3,672,645 | 6/1972 | Terrels | 366/250 |

*Primary Examiner*—Robert W. Jenkins

*Attorney, Agent, or Firm*—Dann, Dorfman, Herrell and Skillman

[57] ABSTRACT

Cup apparatus for use with a spray gun for paints in which the cup has a cover incorporating an impeller for an agitator for stirring the contents of the cup. The impeller is driven by the air supply which is used to generate the spray and the exhaust from the impeller is partially discharged through the cup in a manner to avoid collection of paint in the moving parts.

3 Claims, 4 Drawing Figures

CUP FOR PAINT SPRAYER

The present invention relates to a cup for supplying paint to a conventional spray gun. The invention has particular application to a hand-held spray gun which includes a small supply of paint as an attachment to the gun itself so that the only attachment to the hand-held unit is the attachment of a supply of compressed air.

In recent years, the paint technology has developed paints which include suspended particles or other materials therein which have a tendency to settle out when allowed to stand. It is therefore desirable to provide means for maintaining the materials in suspension during the painting operation so as to avoid separation of the suspended material from the paint. The present invention may be used in spraying other materials whose characteristics are such that it is desirable to maintain agitation of the material during the spraying operation.

It is desirable to provide an improved paint cup of this character which is readily disassembled for cleaning and repair, particularly since paint material tends to quickly set up and harden, making it necessary to flush or otherwise clean the apparatus to avoid clogging. If the apparatus is readily disassembled and the parts are designed to be easily cleansed, the maintenance of the unit is facilitated.

It is also desirable to provide a cup assembly which may be readily dismantled and which may be readily flushed to permit easy changeover from one color to another without any substantial danger of contamination of the new color by remnants of the old color which might be retained within the cup due to incomplete flushing of the assembly.

With the foregoing in mind, the present invention provides a cup attachment for a sprayer which is of simplified construction and yet which is fully effective in operation and use.

More particularly, the present invention provides a cup attachment having an agitator incorporated therein which is driven by the air supply used as a carrier for the material in the cup and which operates in conjunction with the operation of the sprayer to agitate the contents of the cup as the material is sprayed.

The present invention permits a rapid color changeover by simply removing the cup reservoir from the cover and substituting a reservoir having a solvent contained therein. Operating the spray gun then flushes the assembly with the solvent and eliminates any residual paint material which might be retained within the assembly. After flushing, a reservoir with the fresh color may be mounted in the assembly.

In particular, the present invention provides a cup attachment having an agitator incorporating a vane-type impeller which is driven by compressed air and which is mounted in the cup in a fashion to facilitate ready disassembly for cleansing and replacement. Means is provided for exhausting the air from the impeller chamber in major part directly to the atmosphere and in minor part through the cup to the atmosphere without danger of exhausting the contents of the cup along with the air.

The present invention provides an assembly which may be used by operators of varying skills without loss of the contents through spillage or leakage.

All of the objects of the invention are more fully set forth hereinafter with reference to the accompanying drawing, wherein.

Figure 1:
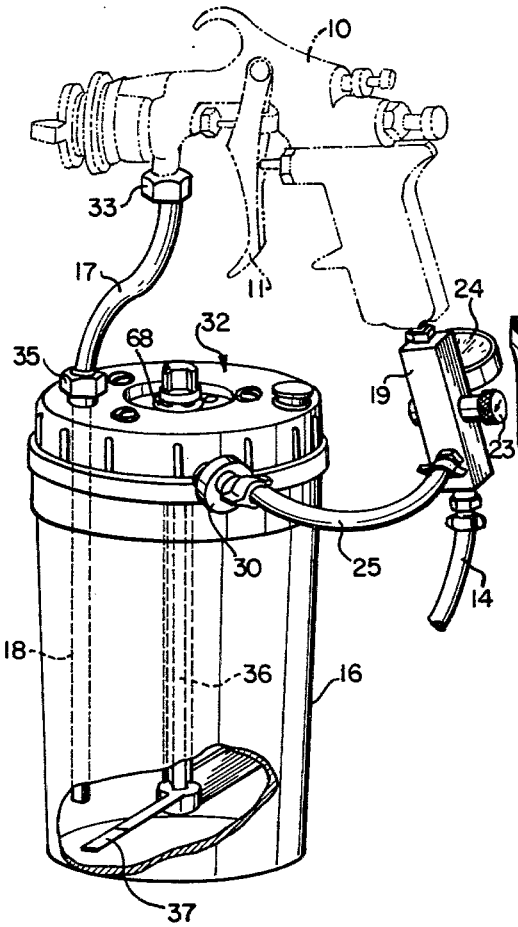
FIG. 1 is a perspective view of a sprayer having a cup attachment made in accordance with the present invention.

Referring now to the drawing, the spraying assembly of the present invention includes a spray gun 10 which may be of conventional form having the usual trigger 11 for operating it. The trigger 11 controls the flow of air through the gun, which is supplied thereto by a line 14. The flow of air through the gun operates to aspirate paint from a reservoir 16 through an aspirating tube 18 connected by a rigid rube 17 to the gun adjacent the spray nozzle thereof. As shown in FIG. 1, the spray gun 10 is of conventional design and the operating controls thereof need not be described in detail. The reservoir 16 has a cover assembly 32 which mounts an impeller for agitating the contents of the reservoir. Preferably, a manifold control assembly 19 is mounted in the supply line 14 adjacent the gun having an individual control valve 23 therein for regulating the pressure to the gun. The manifold assembly also admits air pressure to the impeller for the cup 16 and enables a pressure reading of the air pressure supplied to the gun. To this end, the assembly 19 includes a manifold 22, the control valve 23, a pressure gauge 24, and a branch conduit 25 leading to the cover.

When the air supply is connected to the gun by the line 14, the flow of air to the cover 32 of the cup is initiated. The airflow through the conduit 25 is controlled by a valve assembly 30 at the other end of the conduit where it enters the cover assembly 32. As described below, the valve assembly 30 controls the speed of the impeller and thereby agitation of the material within the cup.

The cup assembly includes the reservoir or cup 16 which preferably is of a material which is readily cleansed and is inert or non-reactive with the material to be sprayed by the gun. Preferably, the volume of the reservoir 16 is sufficient to maintain an adequate supply of spray material and yet is not sufficiently large as to detract from the maneuverability of the gun with the cup attached. For most paints, preferably the reservoir 16 is aluminum and is embossed with measure markings to enable the cup to be used as a measuring device for the paint to be used. The reservoir 16 is attached to the gun through the medium of the cover assembly 32 which also serves as a support for the reservoir. The cover assembly 32 is supported from the gun by means of the rigid tube 17 which is rigidly connected to the gun, as indicated at 33, and is rigidly connected to the cover, as indicated at 35. In this fashion, the rigid connection between the gun and the cover suspends the cover from the gun for ready maneuverability of the gun during painting operation.

In accordance with the invention, the cap assembly 32 of the reservoir 16 rotatably mounts an agitator shaft 36 disposed centrally therein having stirring blades 37 which sweep the bottom of the reservoir and operate to stir the contents, maintaining any suspended material in the liquid contents in suspension and providing agitation of the material as long as the agitator shaft 36 is rotated. The agitator shaft is rotated by an impeller wheel 38 housed within an impeller housing 39 in the cover assembly of the cup. As shown, the impeller wheel has a plurality of substantially radial vanes 42 adapted to sweep the cylindrical wall of the impeller chamber. Compressed air is introduced into the impeller through a valve chamber 43 having a discharge jet 44 which is disposed at a substantial angle to the radial direction (almost tangential) so that the air introduced through the jet 44 rotates the impeller wheel within the chamber. A valve element 41 is axially displaceable in the chamber 43 to regulate the jet of air impinging against the vanes 42. To this end, the valve element 41 is journalled in an adjusting wheel 40 which is threaded into the cover 32 to afford axial adjustment of the valve element 41 in the valve chamber 43. By controlling the flow through the jet 44, the rotary speed of the agitator may be regulated.

A major portion of the air used in driving the impeller is exhausted through exhaust ports 45 in the upper wall of the chamber 39. The ports are spaced circumferentially from said jet opening 44 to enable the air to rotate the impeller wheel 38. The impeller wheel 38 is directly mounted on and is keyed to the agitator shaft 36, as shown at 46, and the shaft is journalled for rotation in a sleeve bearing 47 in the top of the cover assembly and a similar bearing 48 in a cylindrical boss extending below the bottom of the cover assembly. The sleeve bearings are preferably made of Teflon or similar non-fouling material and are sufficiently loose to permit limited air flow between the bearing and the impeller shaft.

In accordance with the invention, applicant found that by allowing a partial exhaust from the impeller chamber through the bottom sleeve bearing 48, a seal or packing intermediate the impeller chamber 39 and the reservoir 16 is unnecessary. Inasmuch as during use of the hand-held sprayer, the impeller is operated continuously, the air used for driving the impeller is continuously exhausted through the exhaust ports 45 and the sleeve bearing 48 into the reservoir 16. To reduce the chance of paint or other material splashing into the sleeve bearing 48, the impeller shaft is provided with a fling wheel 52 which is disposed immediately below the sleeve bearing and is made integral with the agitator shaft 36. Thus, when the agitator shaft is rotating, the fling wheel operates to direct any material which splashes upwardly against it radially outward by centrifual force. This radial deflection of the material maintains the sleeve bearing substantially free of paint or other material. Furthermore, the rotation of the fling wheel 52 tends also to direct the air discharged through the sleeve bearing 48 in a radial outward flow below the undersurface of the cap 32, and the air flow further resists travel of the paint or other material radially inward into the bearing. Thus, in normal operation of the impeller, any liquid tending to splash upwardly is first dirrected outwardly by particles which might be flung outwardly by the undersurface of the fling wheel and furthermore, is further directed outwardly by the air flow caused by the upper surface of the fling wheel.

Figure 2:
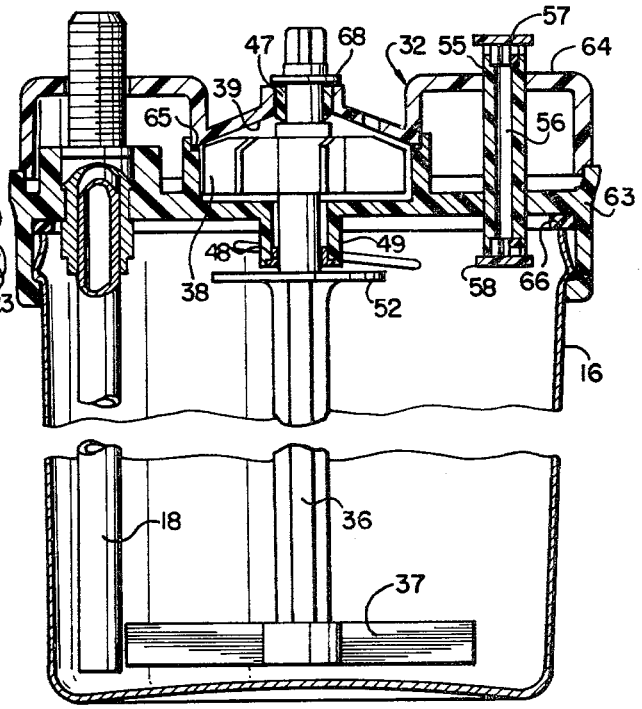
FIG. 2 is a transverse sectional view through the sprayer illustrating the structural features thereof.
Figure 3:
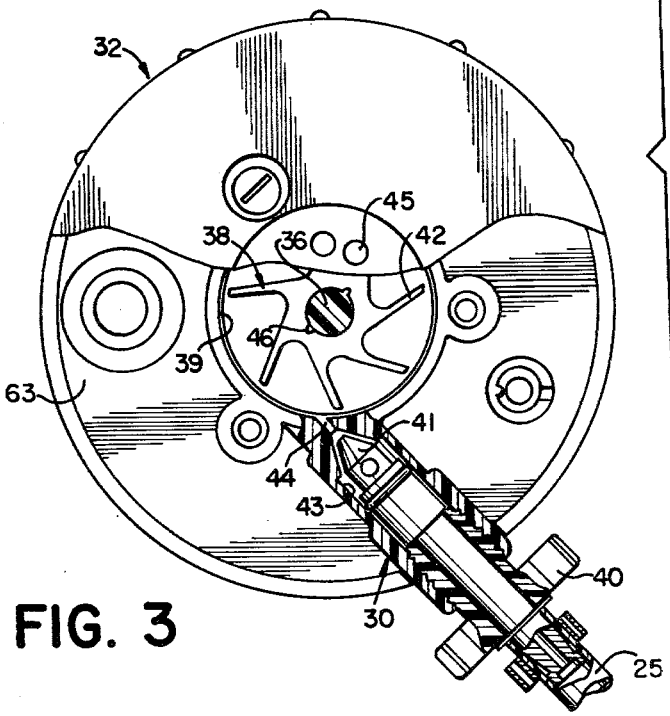
FIG. 3 is an inverted plan view of the cover element of the cup assembly which houses the operating elements thereof.
Figure 4:
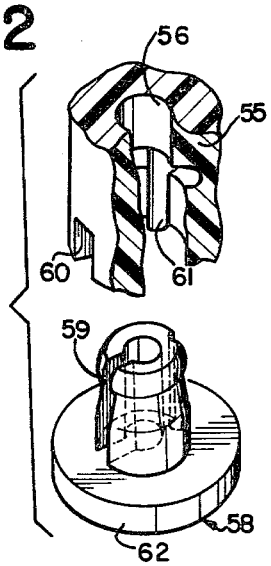
FIG. 4 is a fragmentary perspective view of the exhaust vent of the cover element with parts broken away to more clearly illustrate its construction.

The partial venting of the impeller chamber into the top of the reservoir also assists the aspiration of the paint by the spray nozzle and avoids any possible creation of a vacuum in the reservoir by the displacement of the paint or other material therefrom. Normally, the impeller chamber is subjected to a higher air pressure than the reservoir so the tendency is for the flow to occur downwardly through the sleeve bearing 45. To insure the maintenance of atmospheric pressure in the reservoir, an additional exhaust vent is provided through the cap at a point approximately 180° spaced from the aspirator tube 18. As shown in FIGS. 2 and 4, the vent comprises a vent pipe 55 having a central bore 56 therein which is open at the top to atmosphere through a cap plug 57. The lower end of the vent pipe is also provided with a similar cap plug 58. Each of the plugs 57 and 58 has a venting passageway 59 which is in fluid communication with the interior of the bore 56, and with a notch 60 in the vent pipe. A key is provided at 61 to insure that the passageway 59 registers with the notch 60. Thus, a free passageway is maintained from the top of the reservoir through the passageways 59 and the bore 56, and the cap plugs close the bore against inadvertent entry of foreign particles which might block the air flow through the vent pipe.

It is noted that each cap plug has an outwardly extending rim flange 62 which extends beyond vent pipe, the flow through the notches being confined to the protected surface of the rim flange which confronts the cover. The bleeder passageway provided by this structure is designed primarily for relieving excess pressure within the reservoir and it is anticipated that there will be minimum flow of air therethrough. The structure also will avoid the formation of a vacuum in the reservoir since the passageway through the structure is open for flow in either direction.

The venting passageways may be readily disassembled for flushing and cleaning away any material which might become encrusted or coated thereon. To this end, the caps 57 and 58 are readily removable and the bore 56 of the pipe 55 is easily cleaned. The cap structure itself is preferably formed of a plastic resin which does not adhere to paint and solvent.

The agitator assembly is also readily dismantled for cleansing or replacement and to this end, the agitator shaft is retained in engagement with the cover assembly by a simple E-clip 68 engaged with the shaft 36 above the upper bearing 47. Thus, if the shaft or fling wheel of the agitator should become encrusted or coated with materials as a result of inadequate cleansing after use, it is a simple procedure to disengage the shaft to permit thorough cleaning of the elements.

The cover assembly includes a base element 63 and a lid portion 64. When in place, the lid also completes the impeller housing 39, and to this end, a sealing gasket 65 is mounted about the periphery of the housing 39. A similar gasket material is provided at 66 to preclude paint or other material from escaping through the threaded connection between the cap assembly 32 and the reservoir 16.

The structure of the present invention provides for highly efficient painting operations. Not only does the operation of the assembly provide thorough agitation of the paint during the spraying operation, but the structure enables the paint to be mixed in the reservoir and compounded to provide the desired blend of ingredients. For example, normal spray painting operation requires the paint to be thinned to a more dilute consistency than is normally supplied, and to this end, the supplied paint may be measured into the reservoir 16 and the required amount of solvent may be added to the reservoir. Then, with the cover assembly in place, the valve 30 may be opened to the desired extent so as to admit a flow of air into the inlet 44, thereby rotating the impeller wheel 42 and rotating the stirring shaft 36. Since the painting gun is operated independently by the trigger 11, the spray is not operative and the full air pressure may be used in the impeller chamber to impart the desired stirring action to the ingredients in the reservoir. At full pressure, the agitator may rotate rapidly and may generate splashing. However, the high rotational speed of the agitator shaft 36 in this mode of operation spins the fling wheel 52 sufficiently fast to direct any splashes outwardly, as described above. After the ingredients in the reservoir are thoroughly mixed, the impeller valve assembly may be adjusted to provide the minimum necessary to agitate the cup contents. The manifold valve 23 may then be adjusted to provide the desired pressure in the gun as indicated by the gauge 24. Thus, the present invention provides an efficient startup for the painting operation.

In normal use, after finishing with the color in the reservoir 16, the assembly is readily flushed by simply removing the reservoir 16 with the paint or other material therein and substituting a similar reservoir having a solvent for the material. The solvent, if used promptly, will rinse all of the exposed parts of the assembly and may be sprayed through the gun 10 to clean the operating parts of the gun as well as the operating parts of the cup assembly. When operation of the gun shows that the solvent has thoroughly cleansed all of the parts, it should be unnecessary to perform further cleaning operations. Thus, the present invention provides a structure which is fully effective in operation and use and yet which is susceptible to simple and efficient cleaning at the end of such use and is also susceptible for ready disassembly for maintenance and repair.

While a particular embodiment of the present invention has been herein illustrated and described, it is not intended to limit the invention to such disclosure, but changes and modifications may be made therein and thereto within the scope of the following claims.

I claim:

1. A cup apparatus for use with a hand-held spray gun for spraying paint and similar material comprising a reservoir for said material, aspirator tube means connected to said spray gun and extending to the bottom of said reservoir, a cover assembly for said reservoir, said aspirator tube means rigidly mounting said cover assembly on said spray gun, means for rigidly mounting said reservoir on said cover assembly whereby said reservoir and cover assembly are supported by said hand-held spray gun, said spray gun having an air line for feeding compressed air to said gun, a manifold in said air line having a manually-operable valve and a branch conduit, a connector from said branch conduit to said cover assembly for admitting compressed air from said line to said cover assembly, valve means to regulate the air admitted to said assembly, said cover assembly including a generally cylindrical impeller chamber having a center line coincident with the center line of said cover assembly, means mounting an impeller for rotation about said center line within said impeller chamber including an upper bearing and a lower bearing, said lower bearing mounted in a depending boss disposed centrally of said cover assembly and having a bore open at its lower end into said reservoir, said impeller housing having discharge opening means in the upper wall thereof spaced circumferentially from said compressed air inlet thereto whereby said compressed air is discharged partially to said atmosphere through said discharge opening means after driving said impeller and is discharged partially into said reservoir through said lower bearing and bore, an agitator shaft mounted to said upper and lower bearings extending centrally through said impeller housing and comprising said means mounting said impeller in said housing for rotation about said central axis, said agitator shaft extending axially through said bore into said reservoir and terminating at its lower end in agitator blades adapted to sweep the bottom of said reservoir upon rotation of said agitator shaft, said agitator shaft having a fling wheel mounted thereon immediately below said boss within said reservoir and extending outwardly in a radial direction from said shaft adjacent said boss so as to deflect paint splashing upwardly thereagainst outwardly by centrifugal action, said cover assembly including additional vent pipe means in the cover spaced diametrically from said aspirator tube and having a central bore extending upwardly through said cover, said bore communicating its lower end with said reservoir and at its upper end with the atmosphere whereby said reservoir is adapted to be vented to the atmosphere through the bore of said vent pipe means, thereby to maintain said reservoir at substantially atmospheric pressure, the atmospheric pressure in said reservoir being below the pressure of said impeller chamber whereby the air in said impeller tends to flow downwardly through said bearing and bore from said impeller chamber into said reservoir, and through said vent pipe means from said reservoir to atmosphere.

2. An assembly according to claim 1 including end caps for said vent pipe means positioned at each of said lower and upper ends, said caps including rim flanges extending radially beyond said vent pipe means to provide a protected surface confronting the cover assembly along which venting air may flow, and passage means affording air flow through said cap means and along said surfaces.

3. An assembly according to claim 2 wherein said passage means comprises a notch in said vent pipe means at each end thereof and a venting passage in said cap means, said pipe and cap means having key means to register said passage and said notch.

* * * * *